US011047116B2

(12) United States Patent
Thompson

(10) Patent No.: US 11,047,116 B2
(45) Date of Patent: Jun. 29, 2021

(54) INTEGRATED ACCESS BOX

(71) Applicant: Chad Thompson, Fergus Falls, MN (US)

(72) Inventor: Chad Thompson, Fergus Falls, MN (US)

(73) Assignee: Innovative Tops, LLC, Fergus Falls, MN (US)

( * ) Notice: Subject to any disclaimer, the term of this patent is extended or adjusted under 35 U.S.C. 154(b) by 66 days.

(21) Appl. No.: 16/578,657

(22) Filed: Sep. 23, 2019

(65) Prior Publication Data

US 2021/0087775 A1 Mar. 25, 2021

(51) Int. Cl.

| | |
|---|---|
| ***E03B 9/08*** | (2006.01) |
| ***E02D 29/14*** | (2006.01) |
| ***E02D 29/12*** | (2006.01) |
| ***E03B 9/10*** | (2006.01) |

(52) U.S. Cl.

CPC ..... *E03B 9/08* (2013.01); *E02D 29/12* (2013.01); *E02D 29/14* (2013.01); *E03B 9/10* (2013.01); *Y10T 137/6991* (2015.04); *Y10T 137/6995* (2015.04)

(58) Field of Classification Search

CPC ..... E02D 29/12; E02D 29/14; Y10T 137/6991–7025; E03B 9/08–12; G01V 3/08

See application file for complete search history.

(56) References Cited

U.S. PATENT DOCUMENTS

| | | | | |
|---|---|---|---|---|
| 1,493,936 | A | 5/1924 | Hale | |
| 2,931,383 | A * | 4/1960 | Handley | F16K 31/5284 137/369 |
| 5,577,531 | A * | 11/1996 | Hayden | E03F 7/04 137/369 |
| 6,036,401 | A | 3/2000 | Morina | |
| 6,802,337 | B2 | 10/2004 | Phipps | |
| 6,837,652 | B1 | 1/2005 | Rost | |
| 9,671,515 | B2 | 6/2017 | Saad | |
| 9,777,457 | B2 * | 10/2017 | Mosley | E03B 9/10 |
| 10,451,193 | B2 * | 10/2019 | Freudendahl | E03B 9/02 |
| 10,571,046 | B1 * | 2/2020 | Lambeth | F16L 1/11 |
| 2009/0044869 | A1 * | 2/2009 | Brown | A01G 25/06 137/363 |

* cited by examiner

*Primary Examiner* — Kevin F Murphy
(74) *Attorney, Agent, or Firm* — Neustel Law Offices

(57) ABSTRACT

An integrated access box for providing surface access to a curb box or other structure, and tracer wires in a single unit. The integrated access box generally includes a body having a first end and a second end and a first chamber (e.g., a curb box chamber or cleanout chamber) extending into the first end toward the second end of the body. The body may be substantially cylindrical in shape, and may include a first opening near the first end of the body and a first chamber access opening in the first chamber near the top of the body, and a tracer wire chamber extending into the body. The tracer wire chamber includes a second opening near the first end of the body. The integrated access box may further include a tracer wire access opening in the tracer wire chamber near the top of the body.

18 Claims, 19 Drawing Sheets

INTEGRATED ACCESS BOX

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND

Field

Example embodiments in general relate to an integrated access box for providing access to both line tracer wires and curb boxes used to access curb stop valves.

Related Art

Any discussion of the related art throughout the specification should in no way be considered as an admission that such related art is widely known or forms part of common general knowledge in the field.

Curb stop valves, accessible through curb boxes with grade-level lids, have been in use for many years for allowing people to shut off individual water supplies (between a city water main and a house, for example) using a curb stop valve, also known as simply a curb stop. In addition, usually near but separate from the curb box access location, some cities employ trace wires in order to locate the underground water service lines and water mains by injecting an electrical signal to the wires that are buried near the lines and mains for that purpose. However, tracer wire access requires a separate access box in a homeowner's yard, which can be unsightly and can cause extra expense to install.

SUMMARY

An example embodiment is directed to an integrated access box. The integrated access box includes a body having a first end and a second end, a first chamber (e.g., a curb box chamber) extending into the first end toward the second end of the body. The body of the integrated access box may be substantially cylindrical in shape, or comprise a substantially cylindrical portion, and may specifically be elongated, having a length greater than its diameter, although other shapes are possible. If it is in the shape of an elongated cylinder, the body of the integrated access box may comprise a body in the shape of a cylinder extending from the first end to the second end, wherein each end is a cylinder end.

The curb box chamber may further comprise a first opening proximate the first end of the body. The integrated access box may also include a curb stop access opening in the curb box chamber proximate the second end of the body, and a tracer wire chamber extending into the first end toward the second end of the body, the tracer wire chamber further comprising a second opening proximate the first end of the body, wherein the tracer wire chamber may be isolated from the curb box chamber by the body. The example embodiment may further include a tracer wire access opening in the tracer wire chamber proximate the second end of the body.

In the example integrated access box, the curb stop access opening may comprise a threaded opening to accept a threaded lid. Further, in some example embodiments, the curb box chamber may be substantially in the shape of an elongated cylinder extending from the first end toward the second end, and the curb box chamber may be sized to slidably or frictionally engage a curb box. The body may also comprise a top proximate the second end, and the curb stop access opening in the curb box chamber may comprise an opening in the top which may be, for example, a threaded opening adapted to accept a threaded lid. In addition, the tracer wire access opening can comprise an opening in the top, and the opening may include a terminal box sized and shaped to be removably positioned in the tracer wire access opening, the terminal box comprising a plurality of tracer wire terminals.

In still further example embodiments, the body may comprise a flange that extends beyond the cylindrical portion of the body. The flange may be in the form of a ring-shaped extension at or near the bottom of the body, but may also be formed at other locations, and still serve the purpose of anchoring the integrated access box in the ground.

In another example embodiment, the integrated access box may comprise a body having a first end and a second end, and also a means for mounting the integrated access box on a curb box. The means for mounting may include, but is not limited to, a curb box chamber, such as a substantially cylindrical chamber within the body, extending into the first end toward the second end of the body. The integrated access box in this embodiment may also comprise means proximate the second end of the body for accessing a curb box to adjust a curb stop valve.

This example embodiment may further comprise means proximate the second end of the body for accessing tracer wires. The means may include, but is not limited to, a tracer wire chamber extending into the first end toward the second end of the body, the tracer wire chamber further comprising a second opening proximate the first end of the body, wherein the tracer wire chamber may be isolated from the curb box chamber by the body. The example embodiment may further include a tracer wire access opening in the tracer wire chamber proximate the second end of the body.

In another example embodiment, the integrated access box may be used in conjunction with a sewer cleanout pipe, rather than a curb box. The structure of the embodiment can be similar to the curb box embodiment, although the size and material may be different. For example, the first chamber (similar to the curb box chamber) may be referred to as a cleanout chamber, which may be sized and shaped to fit closely on a riser, rather than a curb box.

The first chamber may further comprise a first opening proximate the first end of the body. The integrated access box may also include a first chamber access opening in the first chamber proximate the second end of the body, and a tracer wire chamber extending into the first end toward the second end of the body, the tracer wire chamber further comprising a second opening proximate the first end of the body, wherein the tracer wire chamber may be isolated from the first chamber (e.g., the cleanout chamber) by the body. The example embodiment may further include a tracer wire access opening in the tracer wire chamber proximate the second end of the body.

In the example integrated access box, the first chamber access opening may comprise a threaded opening to accept a threaded lid. Further, in some example embodiments, the first chamber or cleanout chamber may be substantially in the shape of an elongated cylinder extending from the first end toward the second end, and the first chamber may be sized to closely engage a curb box. Further, the integrated access box may be made of PVC so that the inner walls of the first chamber can be glued to a PVC riser pipe, with the first chamber being sized to exactly or very closely match the outside diameter of the riser pipe. The body may also comprise a top proximate the second end, and the first chamber access opening in the first chamber may comprise an opening in the top which may be, for example, a threaded opening adapted to accept a threaded lid. In addition, the tracer wire access opening can comprise an opening in the top, and the opening may include a terminal box sized and shaped to be removably positioned in the tracer wire access opening, the terminal box comprising a plurality of tracer wire terminals.

There has thus been outlined, rather broadly, some of the embodiments of the integrated access box in order that the detailed description thereof may be better understood, and in order that the present contribution to the art may be better appreciated. There are additional embodiments of the integrated access box that will be described hereinafter and that will form the subject matter of the claims appended hereto. In this respect, before explaining at least one embodiment of the integrated access box in detail, it is to be understood that the integrated access box is not limited in its application to the details of construction or to the arrangements of the components set forth in the following description or illustrated in the drawings. The integrated access box is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Example embodiments will become more fully understood from the detailed description given herein below and the accompanying drawings, wherein like elements are represented by like reference characters, which are given by way of illustration only and thus are not limitative of the example embodiments herein.

DETAILED DESCRIPTION

A. Overview

Figure 1:
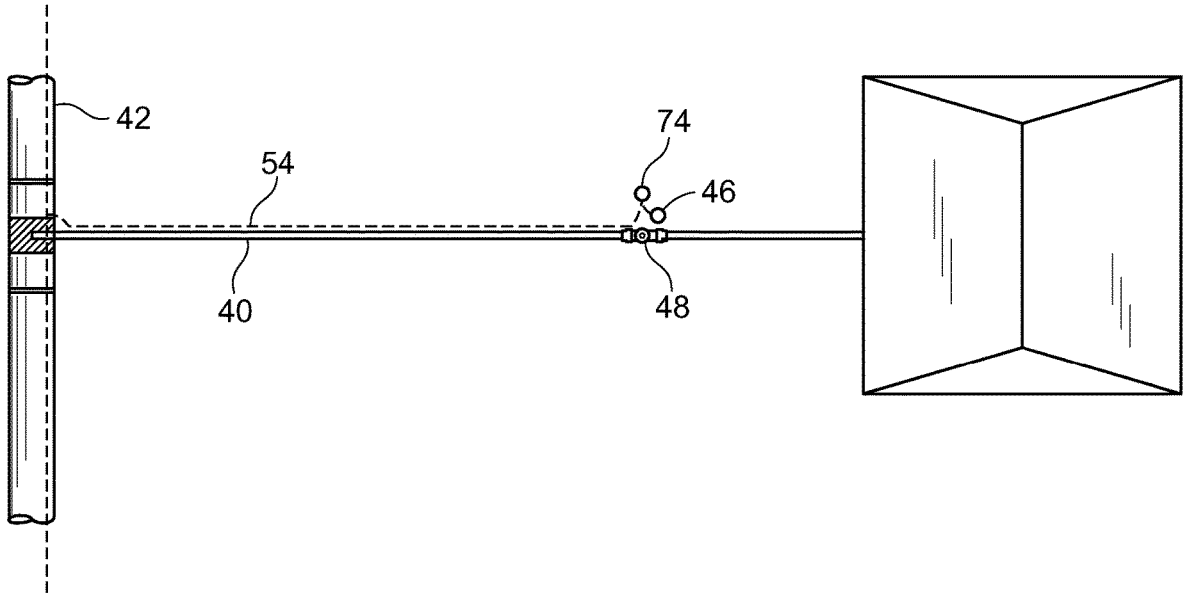
FIG. 1 is a plan view of a portion of a water system where an integrated access box in accordance with an example embodiment may be used.
Figure 2:
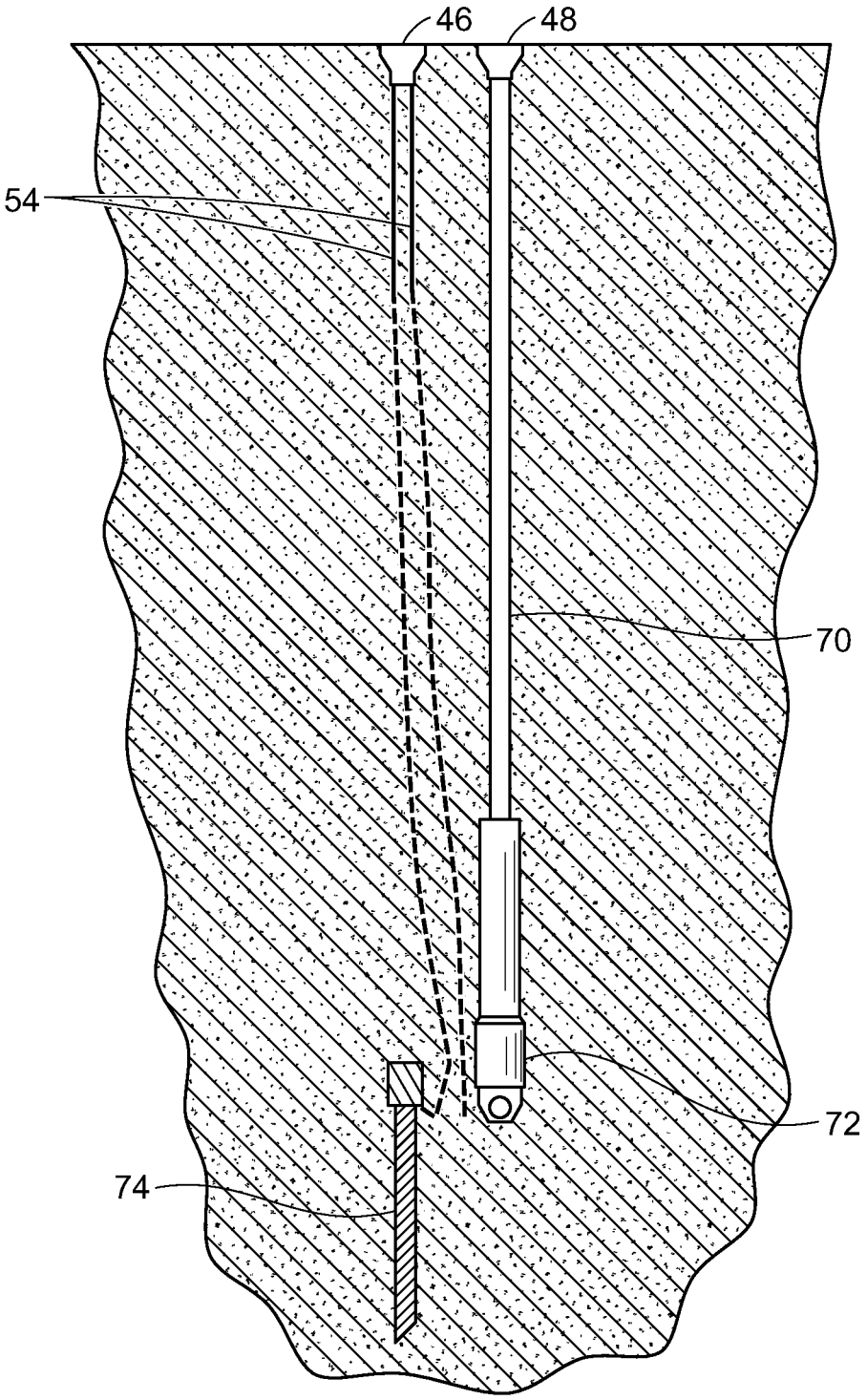
FIG. 2 is an underground view of a portion of a water system where an integrated access box in accordance with an example embodiment may be used.
Figure 3:
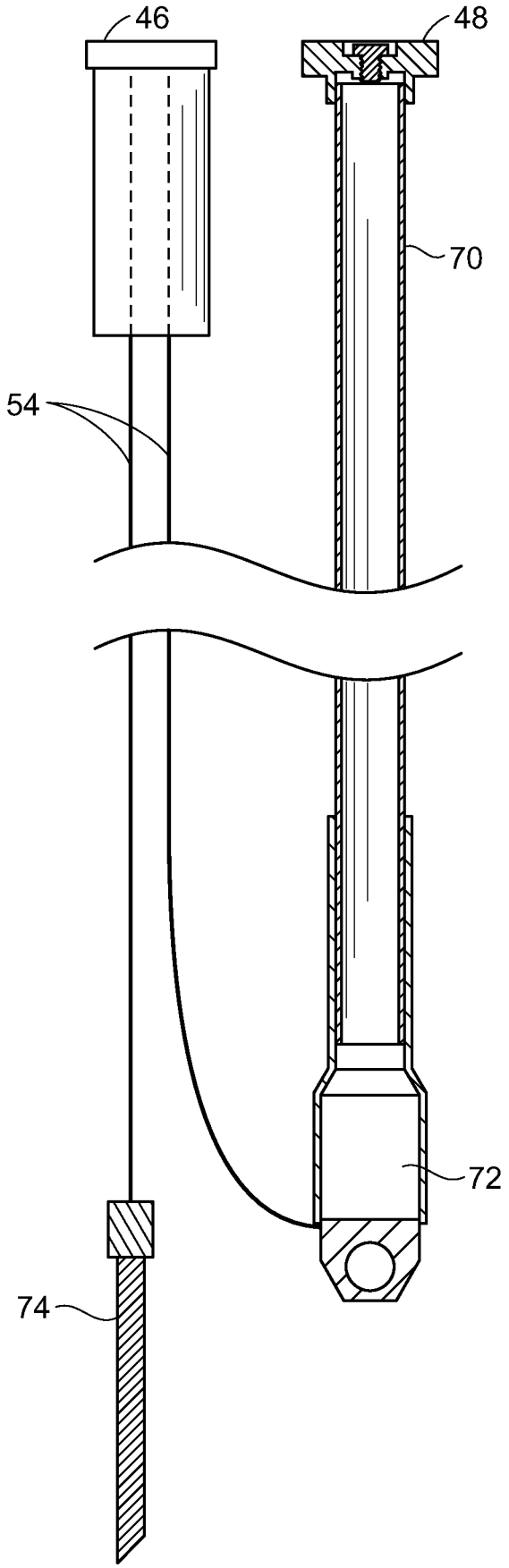
FIG. 3 is a partial sectional view of a portion of a water system where an integrated access box in accordance with an example embodiment may be used.

An example integrated access box 10 generally comprises a body 12 having a first end 14 and a second end 16, and a curb box chamber 20 extending into the first end 14 toward the second end 16 of the body. The body 12 of the integrated access box 10 may be substantially cylindrical in shape, or comprise a substantially cylindrical portion, and may specifically be elongated, having a length greater than its diameter, although other shapes are possible. If it is in the shape of an elongated cylinder, the body 12 of the integrated access box 10 may comprise a body in the shape of a cylinder extending from the first end 14 to the second end 16, wherein each end of the body is a cylinder end.

The curb box chamber 20 may further comprise a first opening 22 proximate the first end 14 of the body 12. The integrated access box 10 may also include a curb stop access opening 24 in the curb box chamber 20 proximate the second end 16 of the body 12, and may also include a tracer wire chamber 30 extending into the first end 14 toward the second end 16 of the body 12, the tracer wire chamber 30 further comprising a second opening 32 proximate the first end 14 of the body, wherein the tracer wire chamber 30 may be, but is not necessarily, isolated from the curb box chamber 20 by the body 12. The example embodiment may further include a tracer wire access opening 34 in the tracer wire chamber 30 proximate the second end 16 of the body 12, and the opening 34 may further be an opening in top 17.

The curb stop access opening 24 may accept a threaded curb stop lid 60. Further, in some example embodiments, the curb box chamber 20 may be substantially in the shape of an elongated cylinder extending from the first end of the body, 14, toward the second end 16, and the curb box chamber 20 may be sized to frictionally engage a curb box 70, which is a common term for the access pipe to a curb stop that is used to turn water off between a water main 42 and a house or building. In addition, the body 12 may further comprise a stop flange 18 that extends beyond the cylindrical portion of the body 12.

The body 12 may also comprise a top 17 proximate the second end 16, and the curb stop access opening 24 in the curb box chamber 20 may comprise an opening in the top 17 which may be, for example, a threaded opening adapted to accept a threaded lid 60. In addition, the tracer wire access opening 34 can comprise an opening in the top 17, and the opening may include a terminal box 50 sized and shaped to be removably positioned in the tracer wire access opening 34, the terminal box 50 comprising a plurality of tracer wire terminals 52 and screws 53.

The integrated access box 10 may also be used in conjunction with a sewer cleanout riser 82. This embodiment is shown in FIGS. 13-19, and is structurally the same or very similar to that described above regarding the curb stop application. As with water service, some municipalities and entities are requiring tracer wires to be placed alongside sewer lines, such as sewer service pipe 80. Accordingly, the integrated access box 10 may be used to provide access to both the cleanout riser pipe 82 and the tracer wires 54. The main differences of this embodiment are the size of the first chamber, which may be referred to as a cleanout chamber 92. As shown in the figures, this chamber may be cylindrically shaped, and be larger in diameter than in the curb box application.

Figure 15:
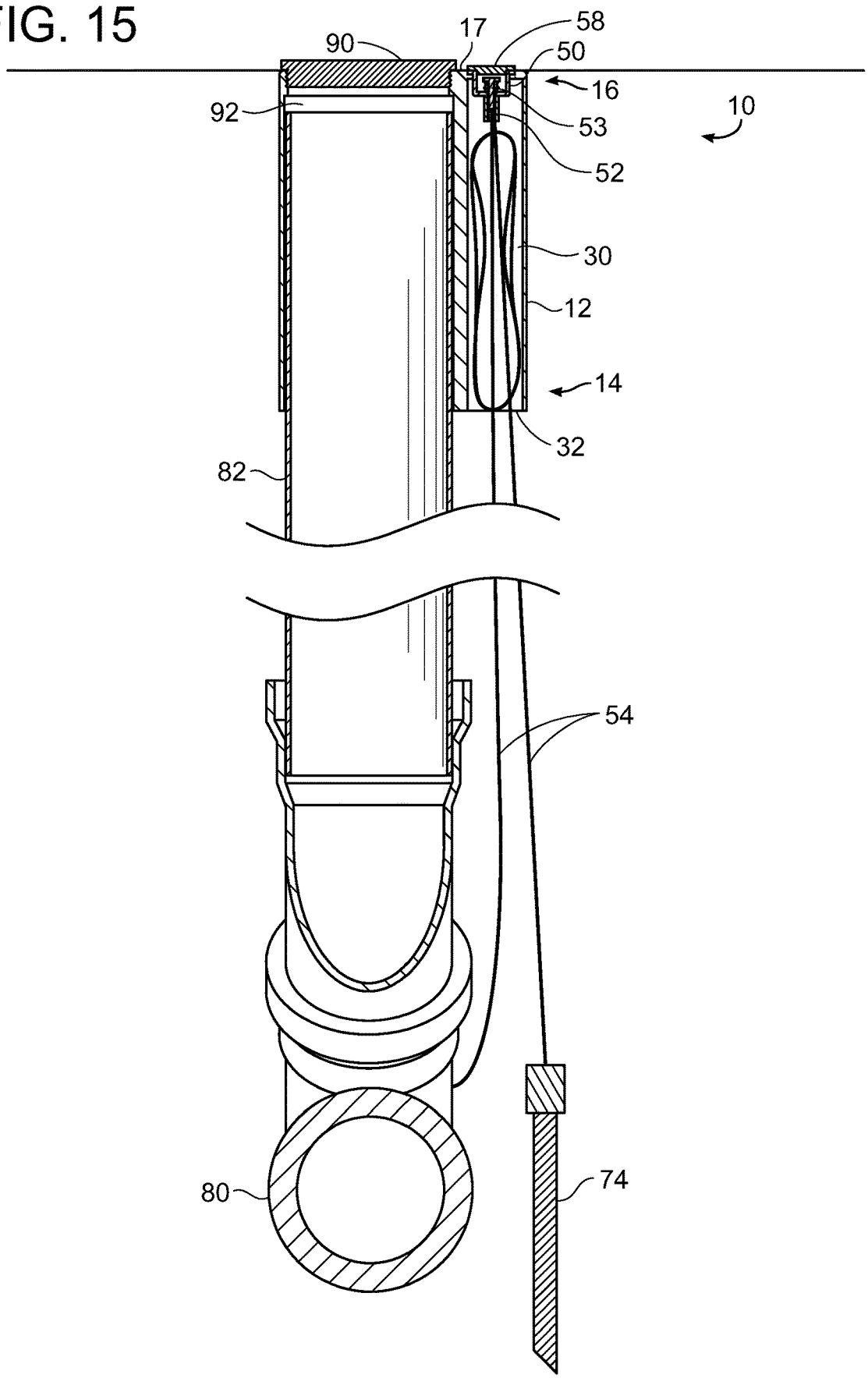
FIG. 15 is another partial sectional view of an installed integrated access box in accordance with an example embodiment.
Figure 16:
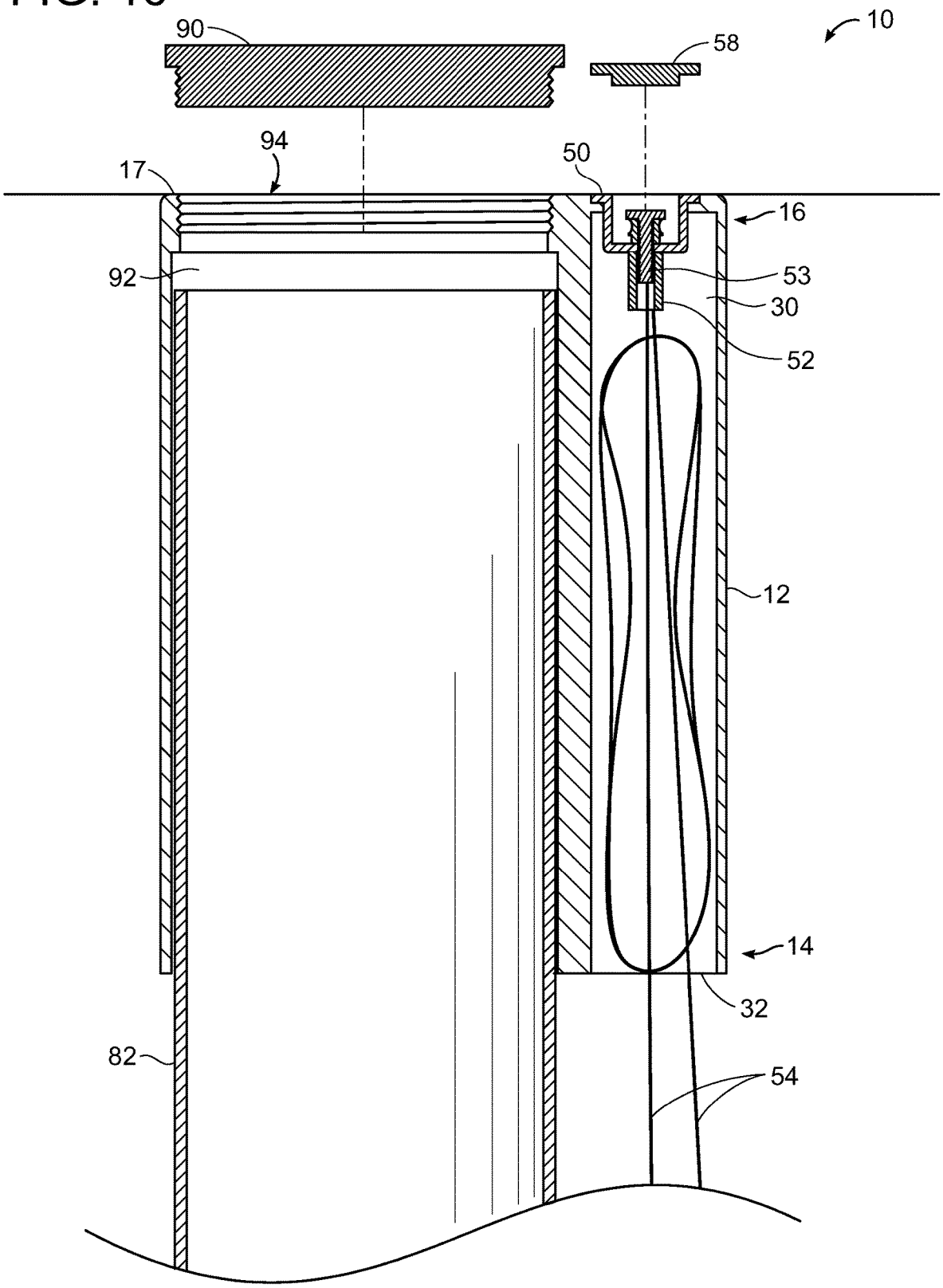
FIG. 16 is sectional view of a portion of an installed integrated access box in accordance with an example embodiment.
Figure 17:
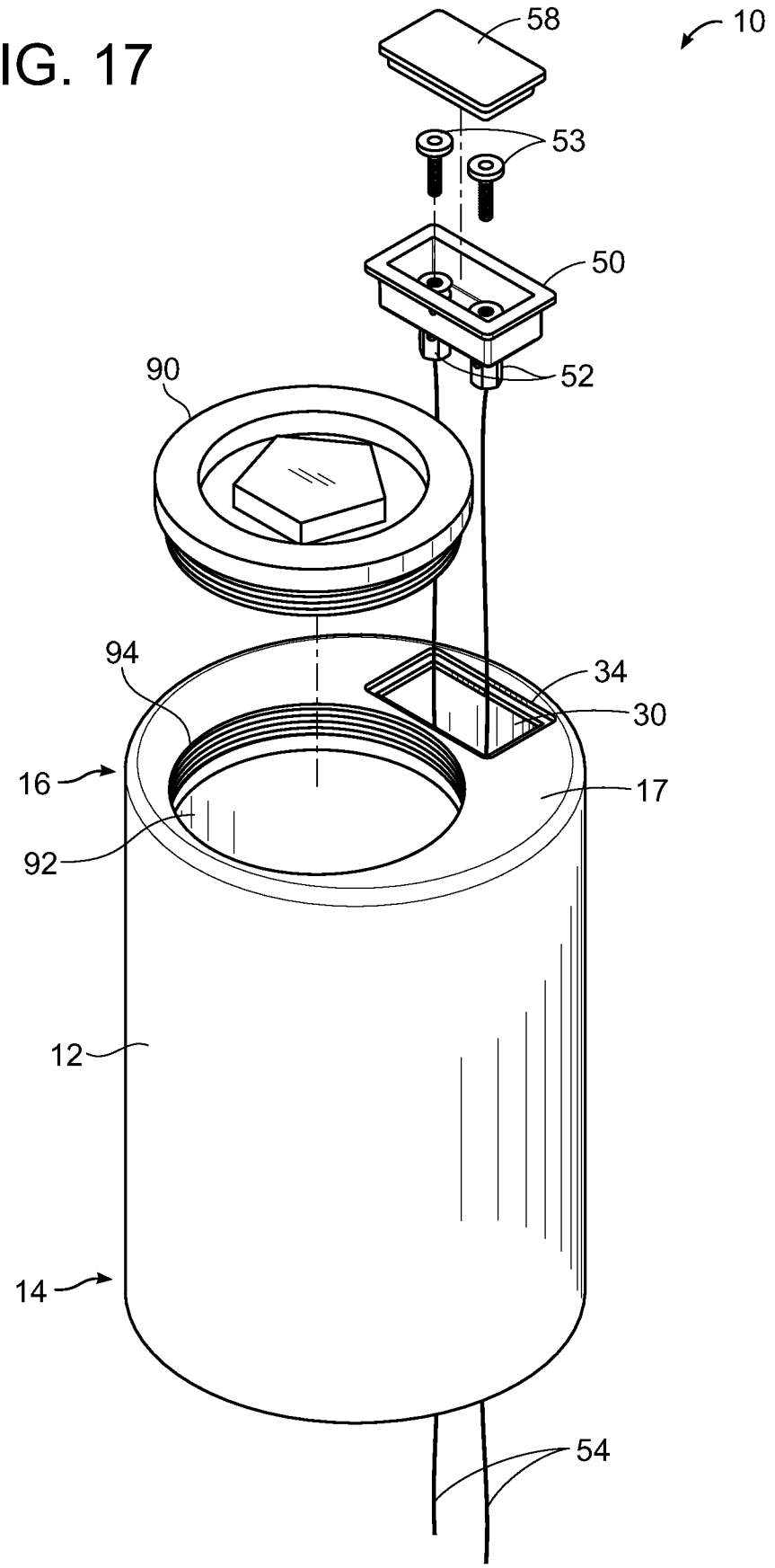
FIG. 17 is an exploded perspective view of an integrated access box in accordance with an example embodiment.

In addition, while either application may comprise a body 12 made of various materials, such as composite, PVC, or even ductile iron, it may be advantageous to make the body of PVC, such as Schedule 40 IPS PVC pipe, that can be glued to a PVC riser 82, as shown for example in FIGS. 15 and 16.

Since sewer connections must be sealed, the cleanout embodiment will typically not have a stop flange 18, because the integrated access box 10 will not be allowed to "float" on riser pipe 82, but will instead be secured to it. The cleanout chamber 92 may have a cleanout first opening 96 at the first end 14 of body 12, and can also include a cleanout access opening (or first chamber access opening) 94 near the second end 16 of body 12.

The body 12 may also comprise a top 17 proximate the second end 16, and the cleanout access opening 94 in the cleanout chamber 92 may comprise an opening in the top 17 which may be, for example, a threaded opening adapted to accept a threaded lid 90. In addition, the tracer wire access opening 34 can comprise an opening in the top 17, and the opening 34 may include a terminal box 50 sized and shaped to be removably positioned in the tracer wire access opening 34, the terminal box 50 comprising a plurality of tracer wire terminals 52 and screws 53.

B. Body

As discussed above, an example integrated access box 10 generally comprises a body 12 having a first end 14 and a second end 16. As shown in FIGS. 8-12, the body 12 may be substantially cylindrical, and more particularly, may have an elongated cylindrical shape. In practice, for example, the body 12 may be about 10 inches long and may have a diameter of about 4½ inches, although of course other dimensions are possible and may even be necessary, depending on the application and the municipality's requirements where the integrated access box 10 will be employed. Further, as discussed above, for embodiments where the integrated access box 10 is installed on a cleanout riser pipe 82, the dimensions will change.

The body 12 may be made of composite material, and may also have UV resistance added for long life even in direct sunlight. Other materials, such as PVC or ductile iron, may also be used. As best shown in FIGS. 5-7, 10, 15-17 and 19, the body 12 may be made with or include two internal chambers, such as a first chamber, curb box chamber 20 or cleanout chamber 92, and a tracer wire chamber 30. As also shown, these chambers 20, 92, 30 may be elongated, extending from the first end 14 to the second end 16 of the body 12. When the body 12 is oriented vertically after installation, the first end 14 will be at the bottom of the box 10, and the second end 16 will be at the top. The chambers 20, 92, 30 may or may not be isolated from each other (for example, by a wall of the body 12), but should allow for the curb stop valve 72 to be operated (accessed through the curb box 70) without interfering with the tracer wires 54.

The integrated access box 10 is designed so that it can be installed on new or existing curb boxes 70 or riser pipes 82, which provide support for the integrated access box 10. However, the integrated access box 10 is not necessarily firmly mounted on the curb box 70. For example, the access box 10, and specifically, the curb box chamber 20, may be designed so that it will slide over and engage with a 1½", 1¼", or 2" curb box 70. In the cleanout embodiment, the cleanout chamber 92 will be sized and shaped so that it will slide onto, and may be glued onto, a riser pipe 82. Other sizes and shapes for the integrated access box 10 or its chambers are also possible in order to accommodate curb boxes or pipes of various sizes, shapes, and materials used in different areas for curb stop valve access, cleanout access, etc. The curb box chamber 20 may be sized so that it frictionally engages the curb box 70, or it may be sized to more freely slide over the curb box 70.

Figure 10:
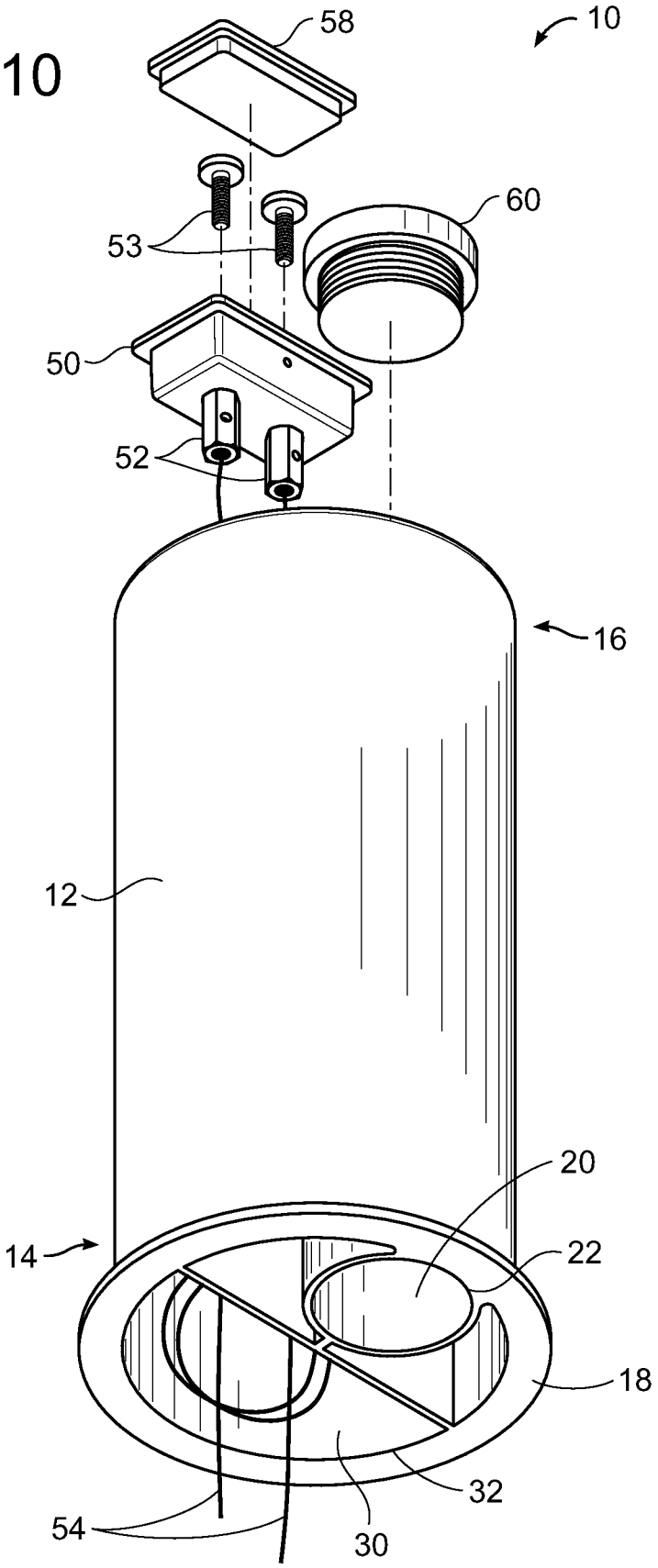
FIG. 10 is an exploded perspective view of an integrated access box in accordance with an example embodiment.
Figure 11:
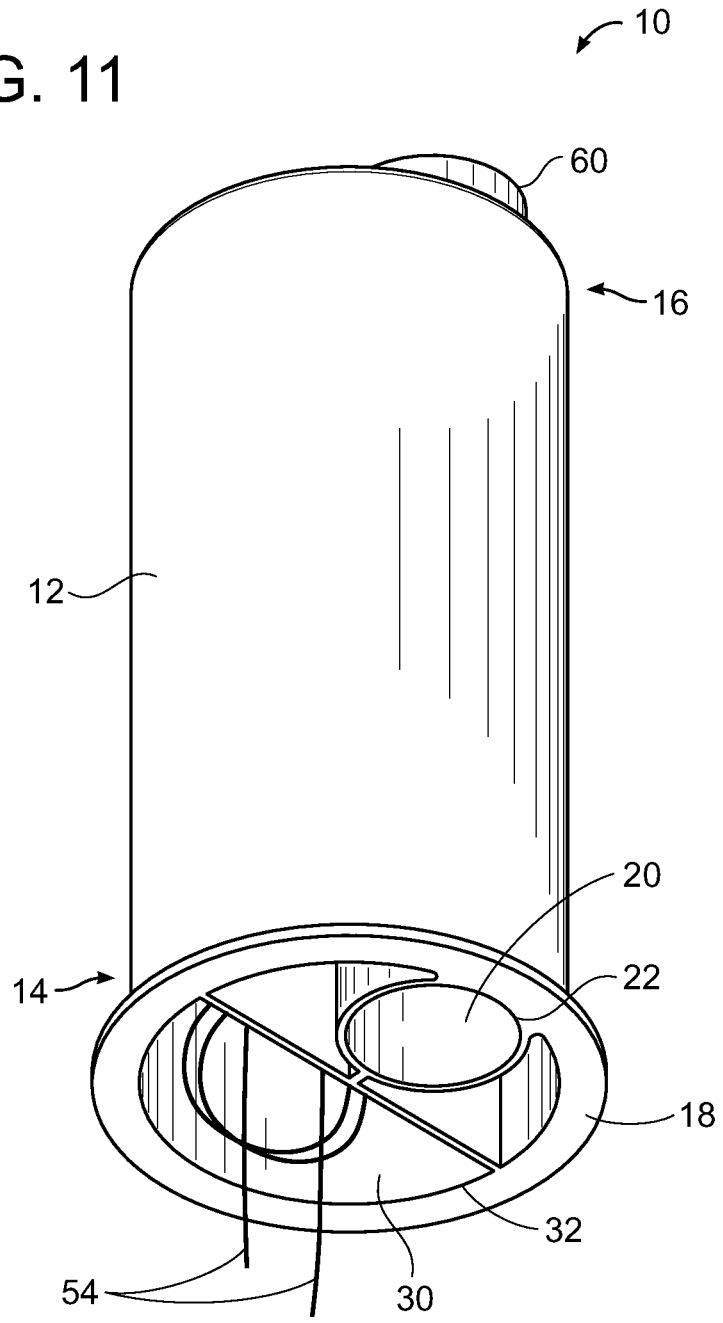
FIG. 11 is a lower, perspective view of an integrated access box in accordance with an example embodiment.
Figure 12:
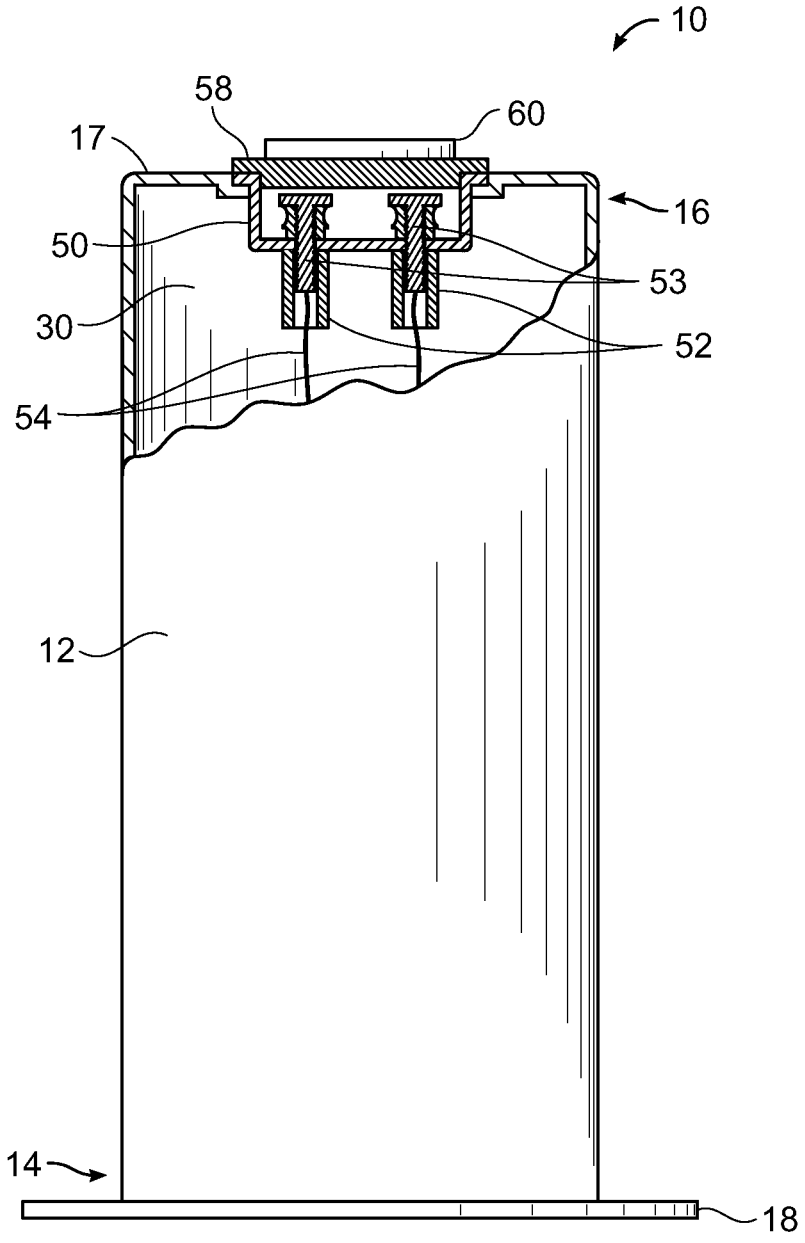
FIG. 12 is a partial sectional view of an integrated access box in accordance with an example embodiment.

As best shown in FIGS. 10-11, the curb box chamber 20 may further comprise a first opening 22 proximate the first end 14 of the body 12. The first opening 22 allows the integrated access box 10 to be placed onto either an existing or new curb box 70. However, the integrated access box 10 is not necessarily secured onto the curb box 70, but instead may slide and displace vertically while still on the curb box 70. Accordingly, the integrated access box 10 may remain properly positioned, such that its top is flush with the ground, during freeze/thaw ground movements, eliminating the problem of access box tops that stick up above the ground or are sunken below ground level. A stop flange 18, which may be a ring-shaped extension beyond the body 12, can help anchor the box 10 relative to the ground while the box "floats" on the curb box 70.

Figure 8:
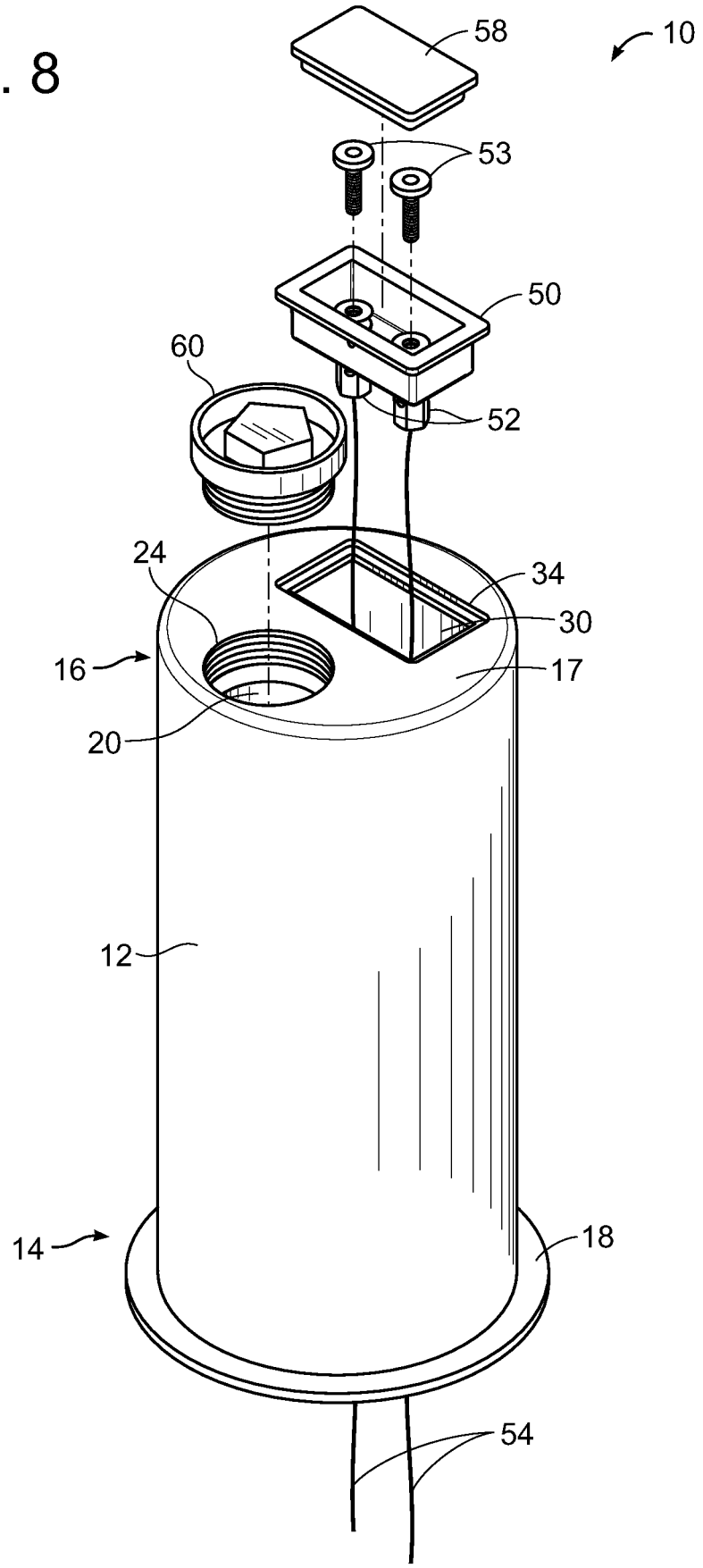
FIG. 8 is an exploded view of an installed integrated access box in accordance with an example embodiment.

The body 12 may also include a curb stop access opening 24 in the top 17 of the curb box chamber 20 near the second end 16 of the body 12. The opening 24 may be a circular, threaded opening which can accept a threaded curb stop lid 60, which allows secure access to the curb box 70 and the curb stop valve 72 that allows for water supply shutoff between the water main 42 and a house or building, as shown in FIG. 1. As with conventional curb stop lids, the curb stop lid 60 may include a five-sided nut for removal (as shown in FIG. 8), which can reduce tampering by unauthorized personnel without special tools.

Figure 5:
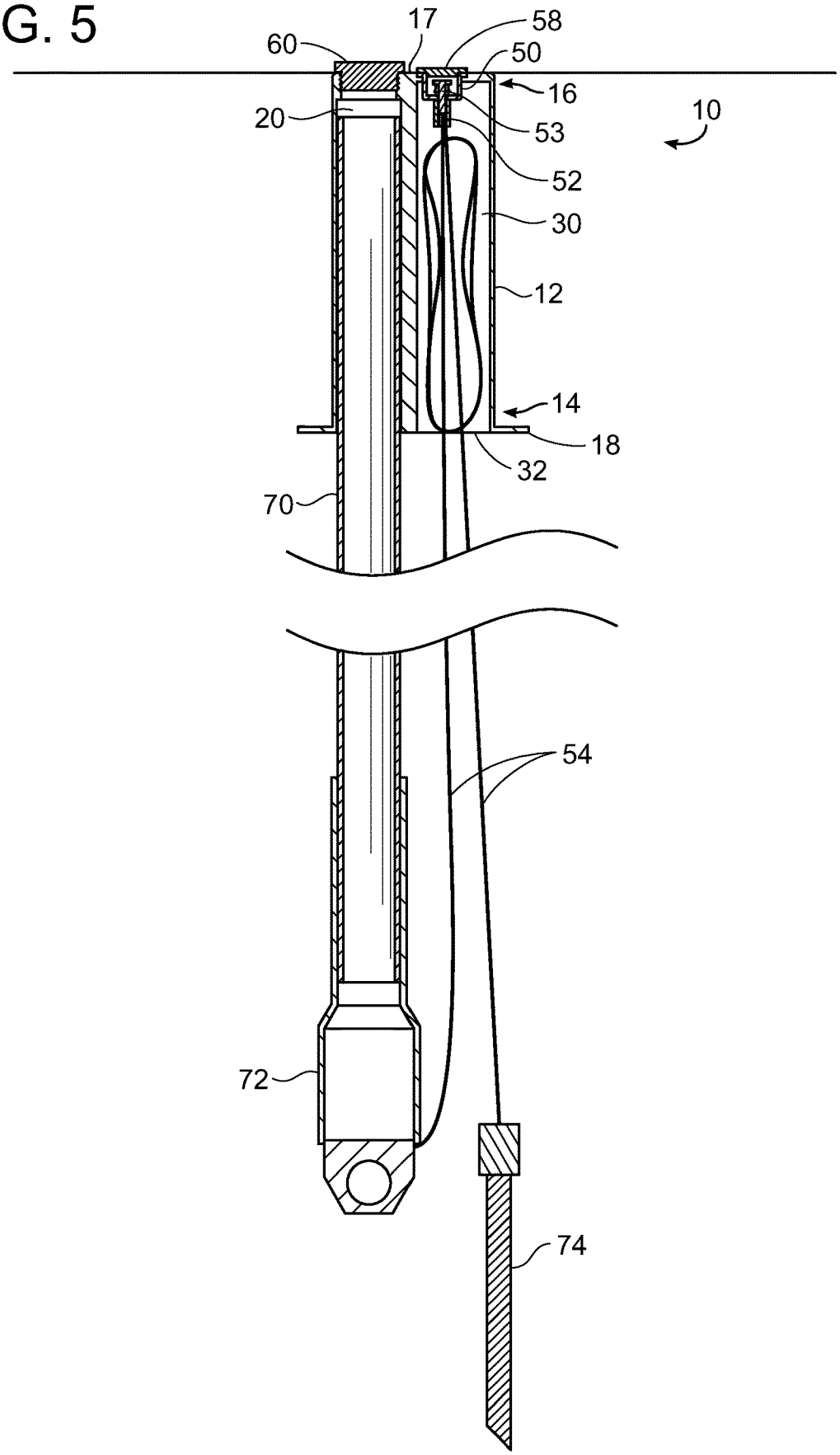
FIG. 5 is a partial sectional view of an installed integrated access box in accordance with an example embodiment.
Figure 6:
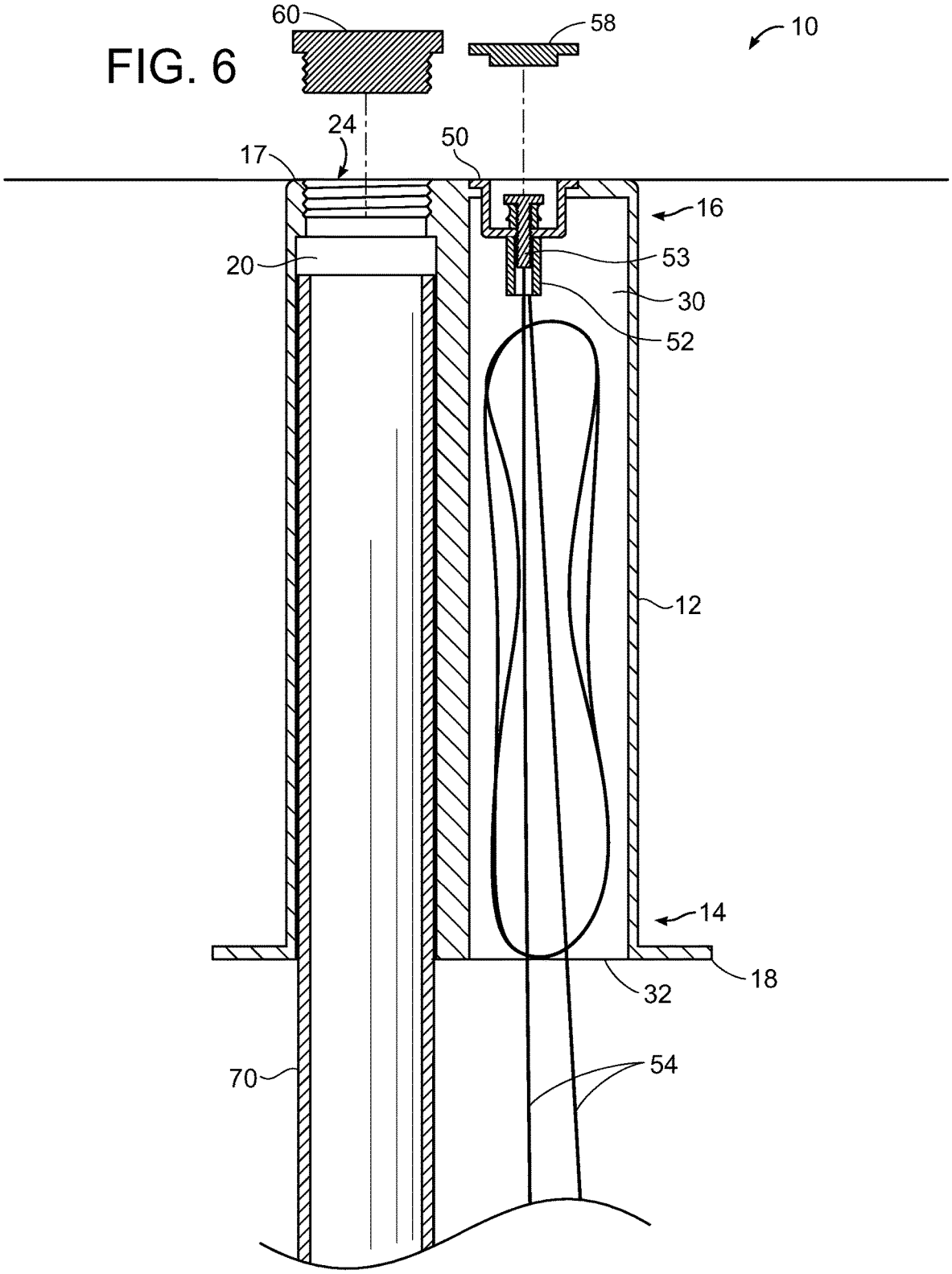
FIG. 6 is another partial sectional view of an installed integrated access box in accordance with an example embodiment.
Figure 7:
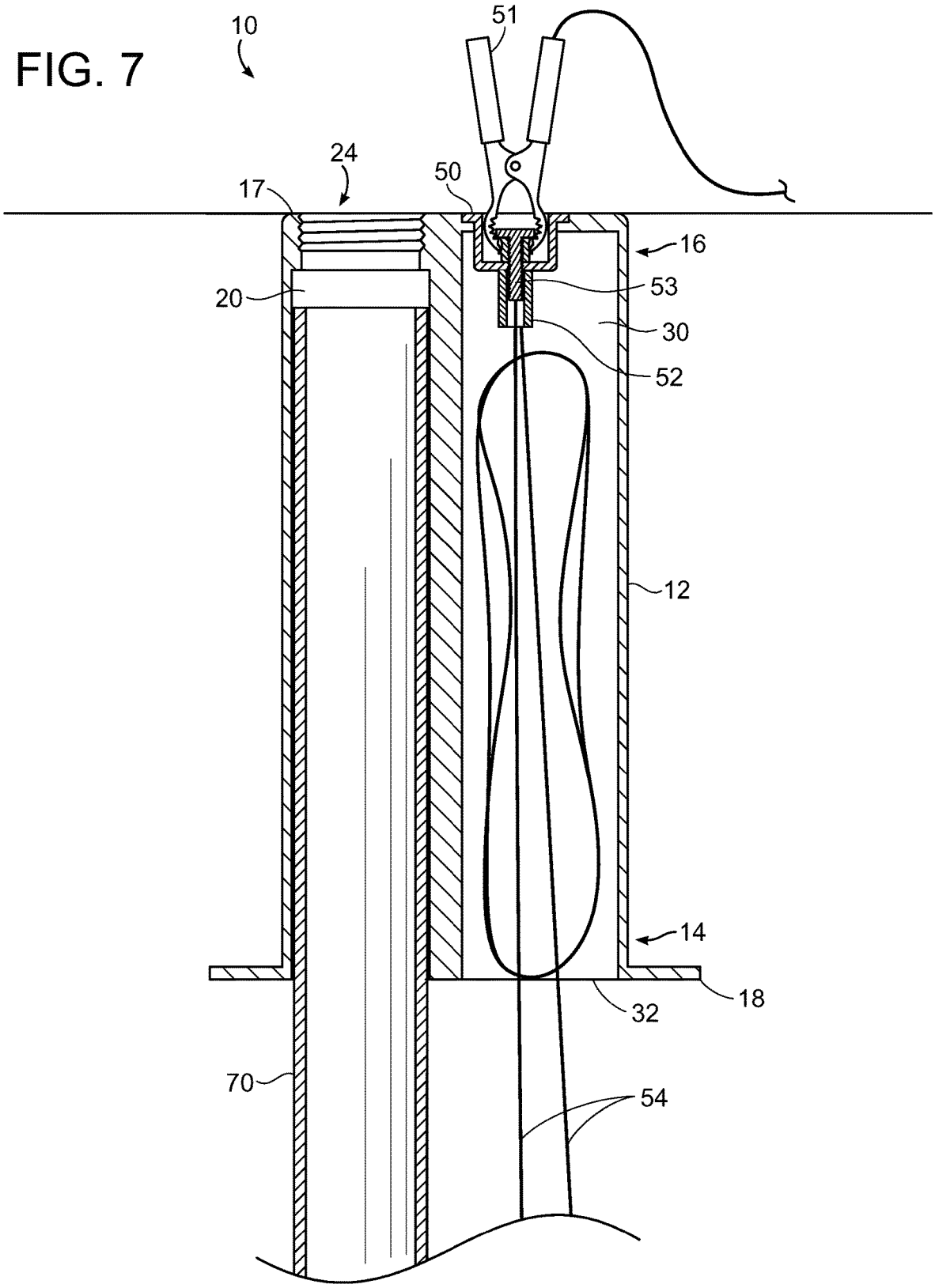
FIG. 7 is another partial sectional view of an installed integrated access box in accordance with an example embodiment.

As shown in FIGS. 5-7, the body 12 may also include a tracer wire chamber 30 extending into the first end 14 (i.e., the bottom of the body 12) toward the top or second end 16 of the body 12, the tracer wire chamber 30 further comprising a second opening 32 at or near the first end 14 of the body. The second opening 32 allows for the ends of buried tracer wires 54 near the water service pipe and the water main to be brought up into the integrated access box 10 (specifically, the tracer wire chamber 30) for easy access at the surface. The tracer wire chamber 30 may or may not be isolated from the curb box chamber 20 by the body 12. The integrated access box 10 may further include a tracer wire access opening 34 in the tracer wire chamber 30 at or near the top or second end 16 of the body 12.

If the body 12 is cylindrical, as shown, the tracer wire chamber 30 may be in the shape shown in FIG. 10, wherein the chamber 30 is formed by an interior wall of the cylindrical body 12, and by a flat or other shaped portion of the body 12 between the tracer wire chamber 30 and the curb box chamber 20. As also shown, these two chambers 20, 30 may be isolated, so that accessing the curb box 70 does not disturb or dislodge the tracer wires 54. For example, a user may from time to time need to open the curb stop lid 60 to insert a stop box key into the curb box 70, to engage the curb stop to turn the water flow to the water service pipe on or off.

C. Terminal Box

At the upper end or second end 16 of the integrated access box 10, the body 12 may include a top 17. The top 17 serves to keep dirt, objects, etc. out of the interior portion of the integrated access box 10. The top 17 also has openings for access to the curb box 70 and the tracer wires 54 from the surface. As shown in FIGS. 5-8, 10, and 15-17, the tracer wires 54 may be terminated in a terminal box 50. The terminal box 50 may be sized and shaped so that it fits securely within an opening 34 in the top 17. However, the terminal box 50 may, for convenience, be removable from the top 17 of integrated access box 10, so that the tracer wires 54 may be brought up above the surface, so that the wires 54 may be worked with and connected to tracer wire terminals 52 and/or screws 53 within the terminal box 50, without the need for a worker bending over to work with the wires 54 very close to the ground.

To further facilitate this connection, and as required by some authorities, extra tracer wire may be coiled within the tracer wire chamber 30, as shown in FIGS. 5-7 and 15-16. In addition, the terminals 52 may be colored or marked to indicate which wire they are connected to. For example, in some municipalities, the ground wire, which is connected to a grounding anode rod 74 below the surface, may be red (i.e., a copper wire with red insulation), while the tracer wire 54 that runs along the water service line may be blue (i.e., a copper wire with blue insulation). The terminals 52 may be so labeled or colored (not shown) for ease of use when tracing equipment is connected to the terminals 52. In addition, a jumper wire (not shown) may be connected between the two terminals 52 whenever the system is not being used to inject a tracing signal onto the wires 54.

Figure 9:
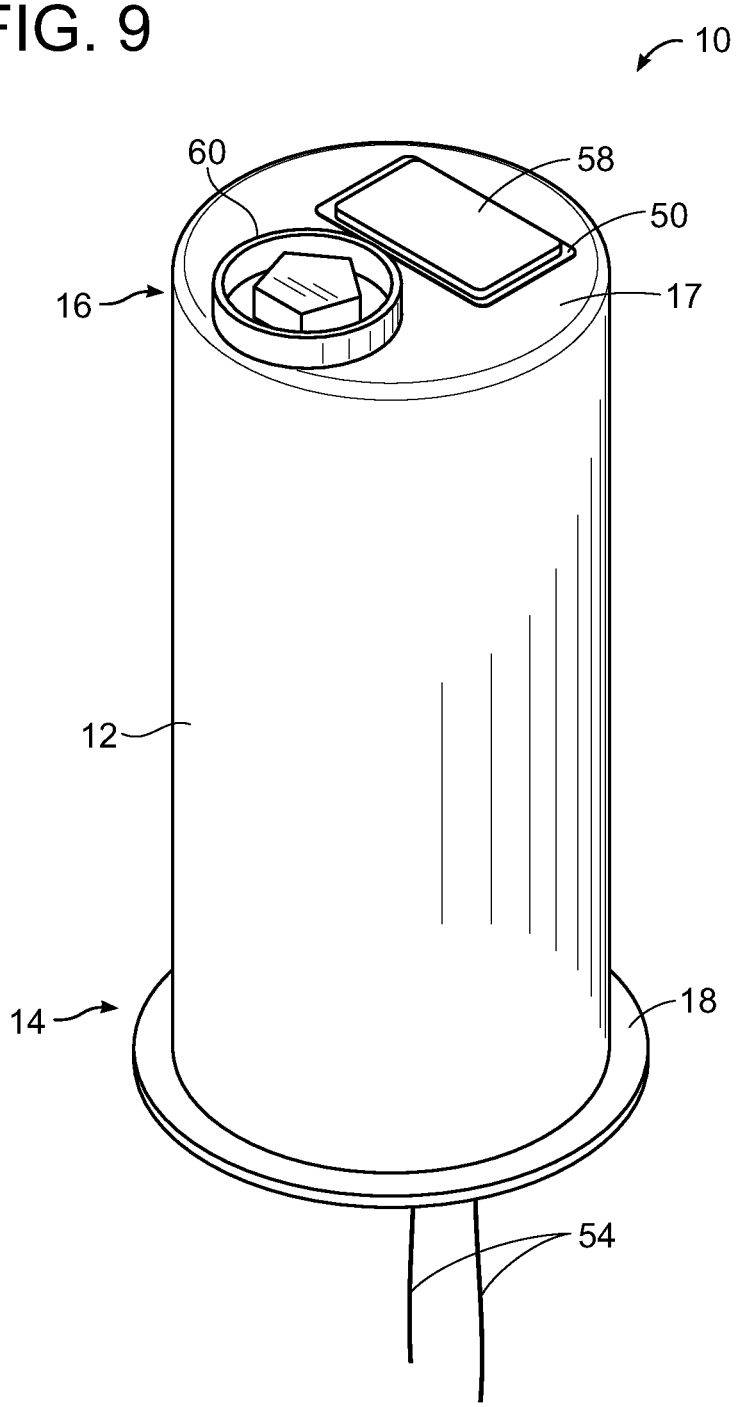
FIG. 9 is an upper, perspective view of an integrated access box in accordance with an example embodiment.
Figure 18:
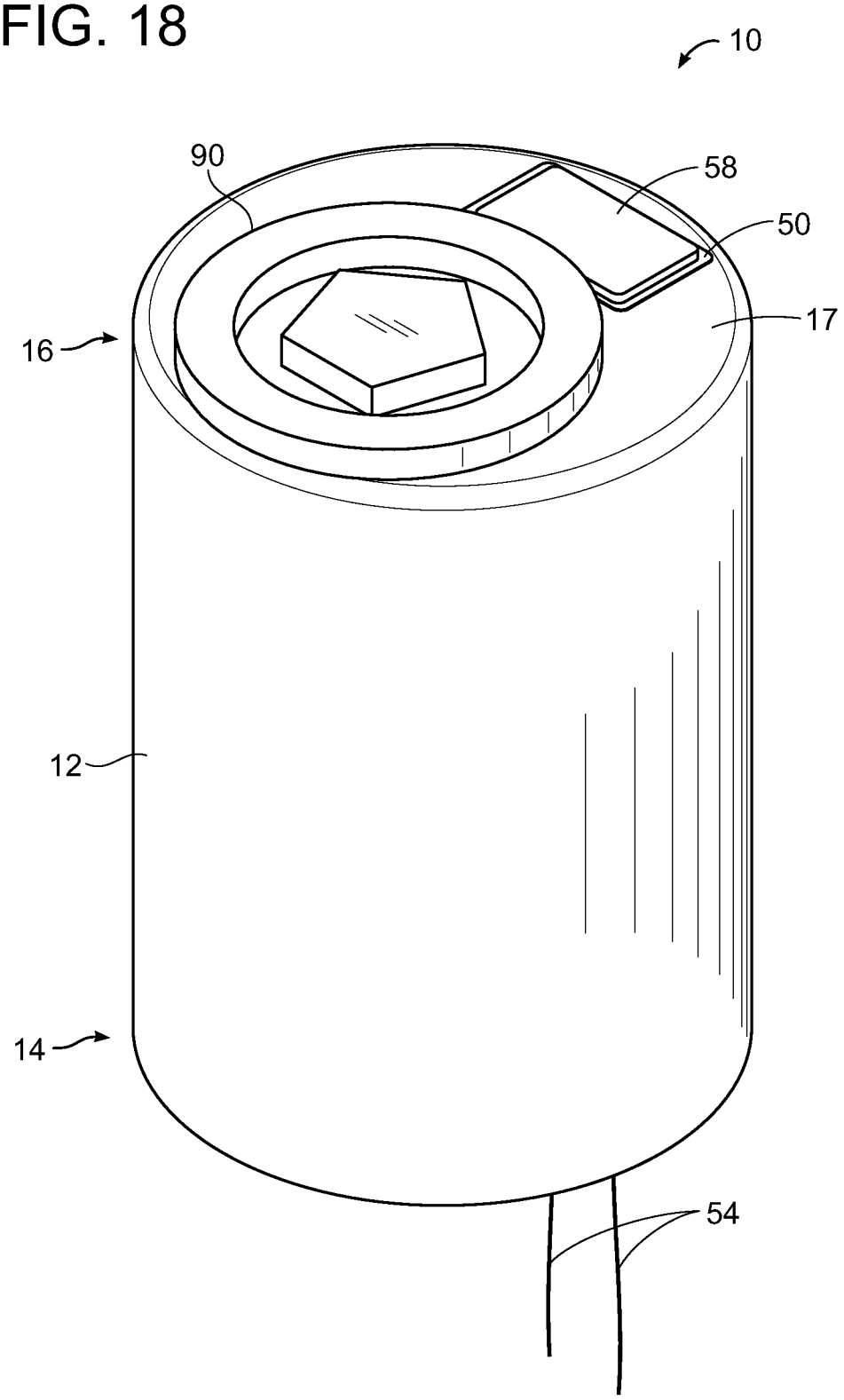
FIG. 18 is an upper, perspective view of an integrated access box in accordance with an example embodiment.
Figure 19:
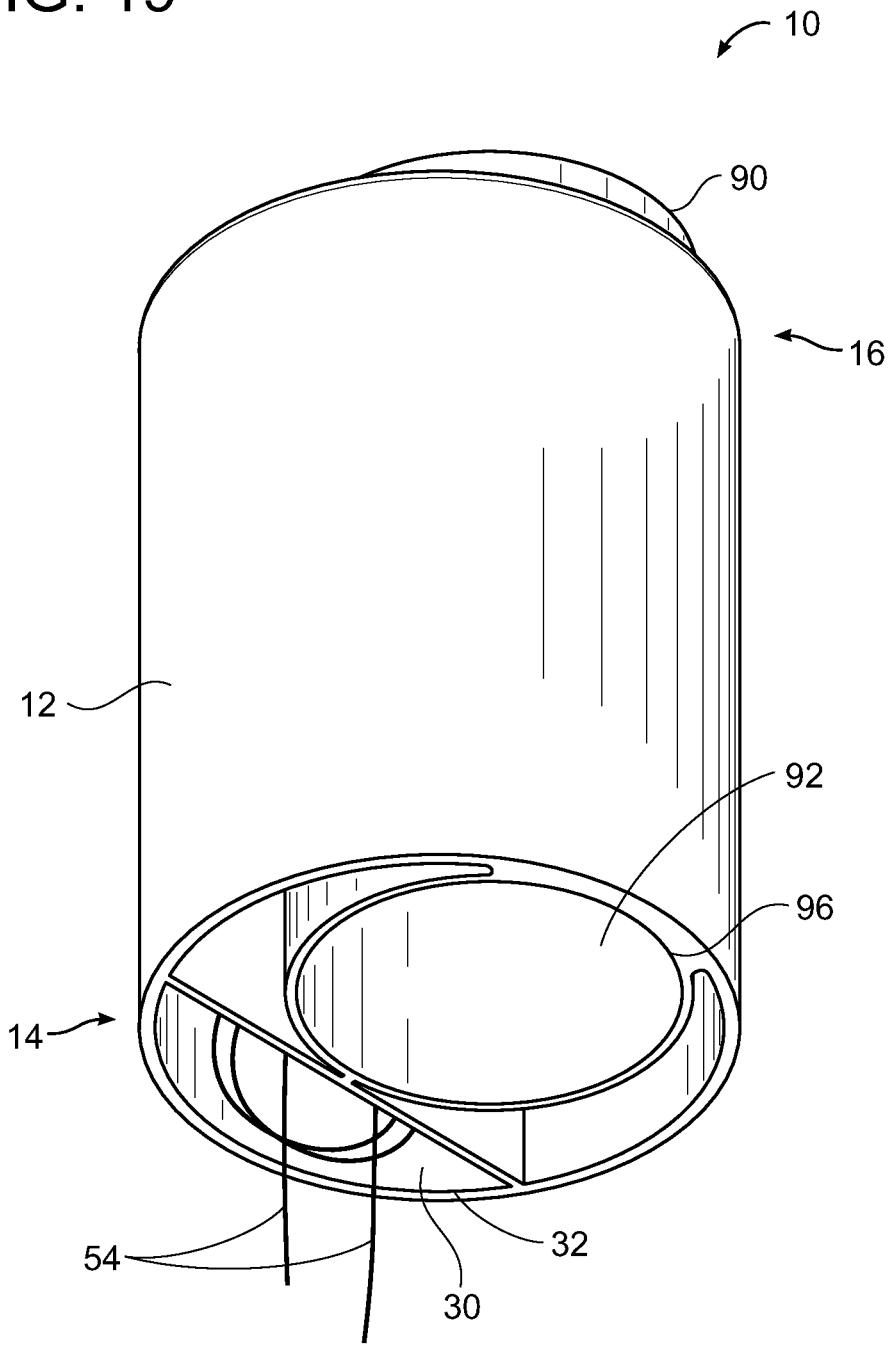
FIG. 19 is a lower, perspective view of an integrated access box in accordance with an example embodiment.

When the terminal box 50 is secured in the top of integrated access box 10, a lid 58 may be inserted or snapped in place to cover and protect the terminals 52, as shown in FIGS. 9, 15, and 18. The lid 58, as well as curb stop lid 60, may be marked for identification (not shown)—for example with the notations "water" and "tracer wire".

D. Operation of Preferred Embodiment

Figure 13:
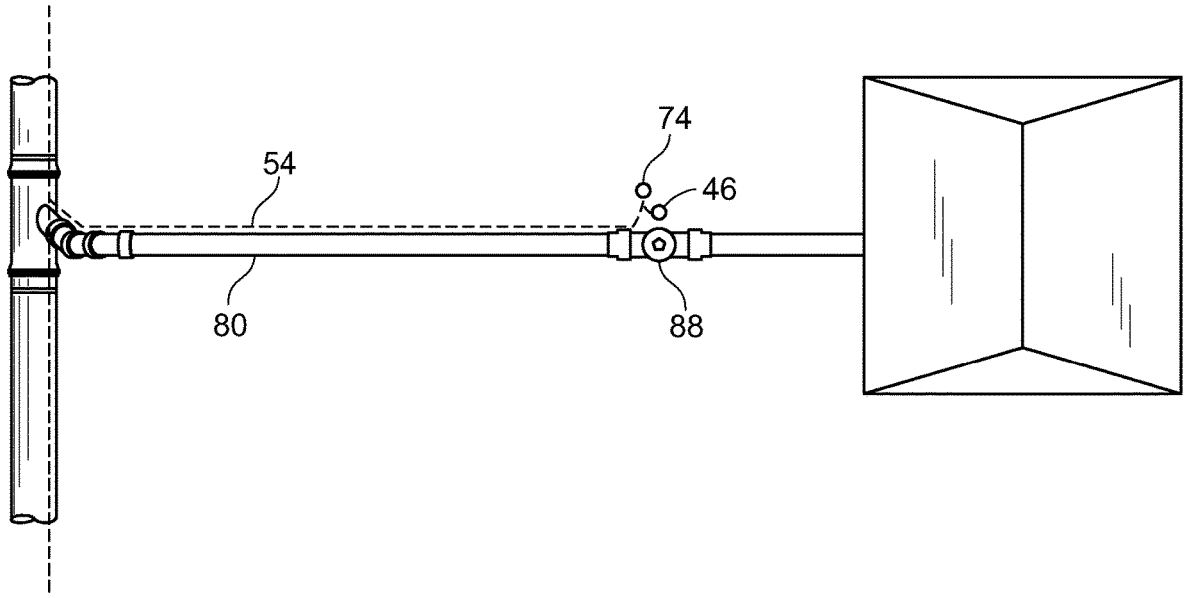
FIG. 13 is a plan view of a portion of a sewer system where an integrated access box in accordance with an example embodiment may be used.

Certain municipalities specify that there must be a tracer wire access box near each water service shutoff valve (i.e., curb stop valve), which is typically at ground level, between a house or building and the water main 42. The same requirement may exist for sewer service pipes. Access boxes (including access caps) are typically buried in the boulevard, or in each homeowner's yard. The integrated access box 10 will eliminate the need for two separate access boxes, and will slide over any existing or new curb box 70 or fit onto a riser pipe 82, and will typically include two tracer wire terminals 52, and a separate chamber 30 within the integrated access box 10 for tracer wire 54. The terminals 52 are used for connecting a line tracer to the tracer wires 54, with one wire being grounded by a grounding anode rod 74, and the other wire for carrying a tracer signal. The plan view of FIGS. 1 and 13 illustrates the overall concept, wherein the active (i.e., non-ground) tracer wire 54 is adjacent to the water service line (or sewer service pipe 80) between the curb box location and the water main 42, and the tracer wire 54 also connects to or runs adjacent to the water main 42 or the sewer line. The other accessible tracer wire 54 is connected to a grounding rod 74, and the two terminals 52, one for each wire, may be jumpered together until the system is actually used for tracing pipe locations.

The integrated access box 10 may be used to replace individual access boxes. With reference to FIGS. 1-4, conventional systems include curb box 70 which provides access to curb stop valve 72, which is underground and allows for water shutoff between water main 42 and a house or building. Typically, the curb box 70 has its own access lid 48. In addition, such conventional systems may include an individual tracer wire access box 46 to allow workers to connect a tracer system to the tracer wires 54, to inject a signal onto the wires for pipe location purposes.

Figure 14:
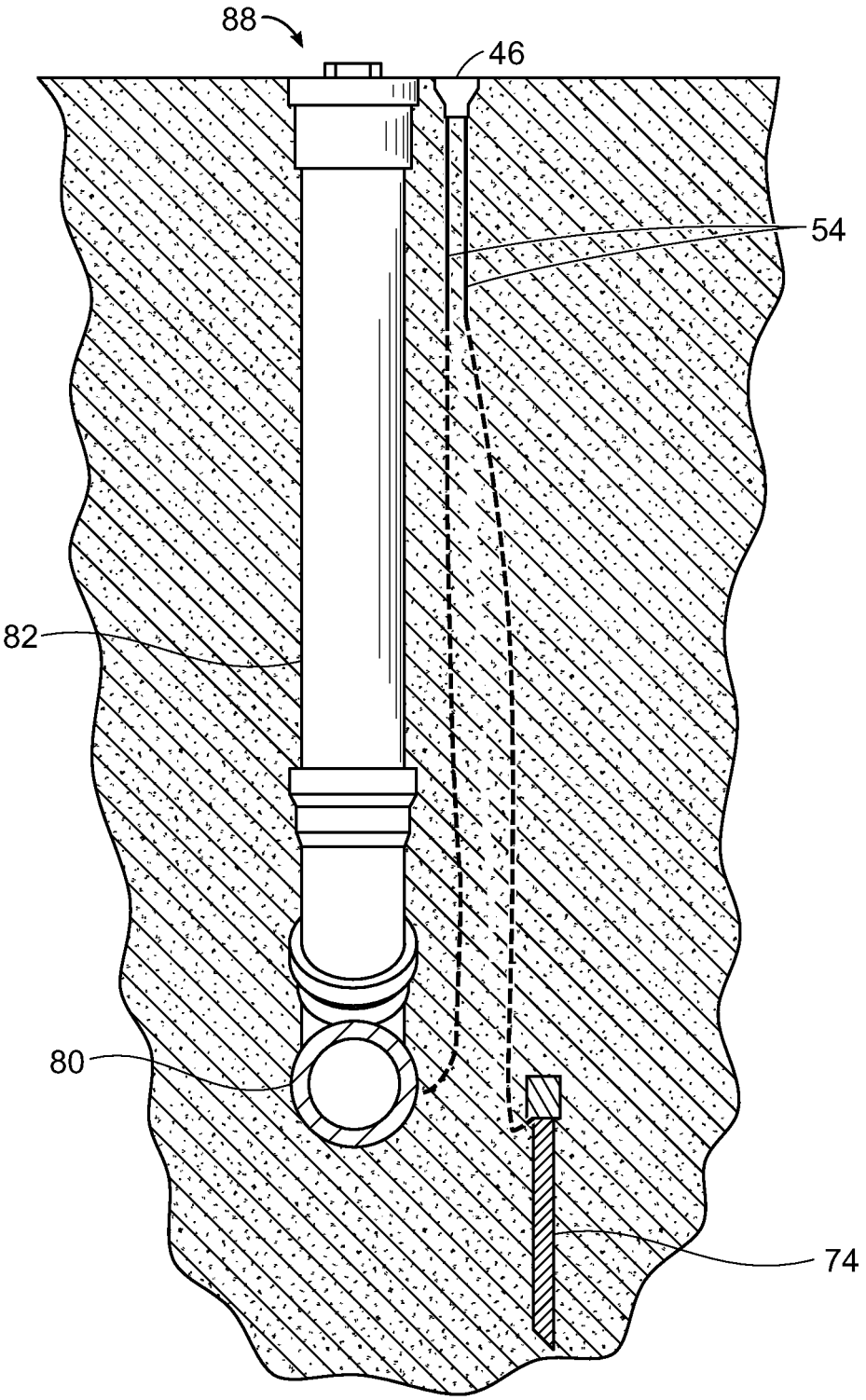
FIG. 14 is an underground view of a portion of a sewer system where an integrated access box in accordance with an example embodiment may be used.

A similar configuration is shown in FIGS. 13-14, which is applicable to a sewer cleanout embodiment, as discussed above. In the cleanout embodiment, the integrated access box 10 is used to replace a conventional cleanout lid 88 and a separate tracer wire access box 46, as shown in FIGS. 14-15.

Figure 4:
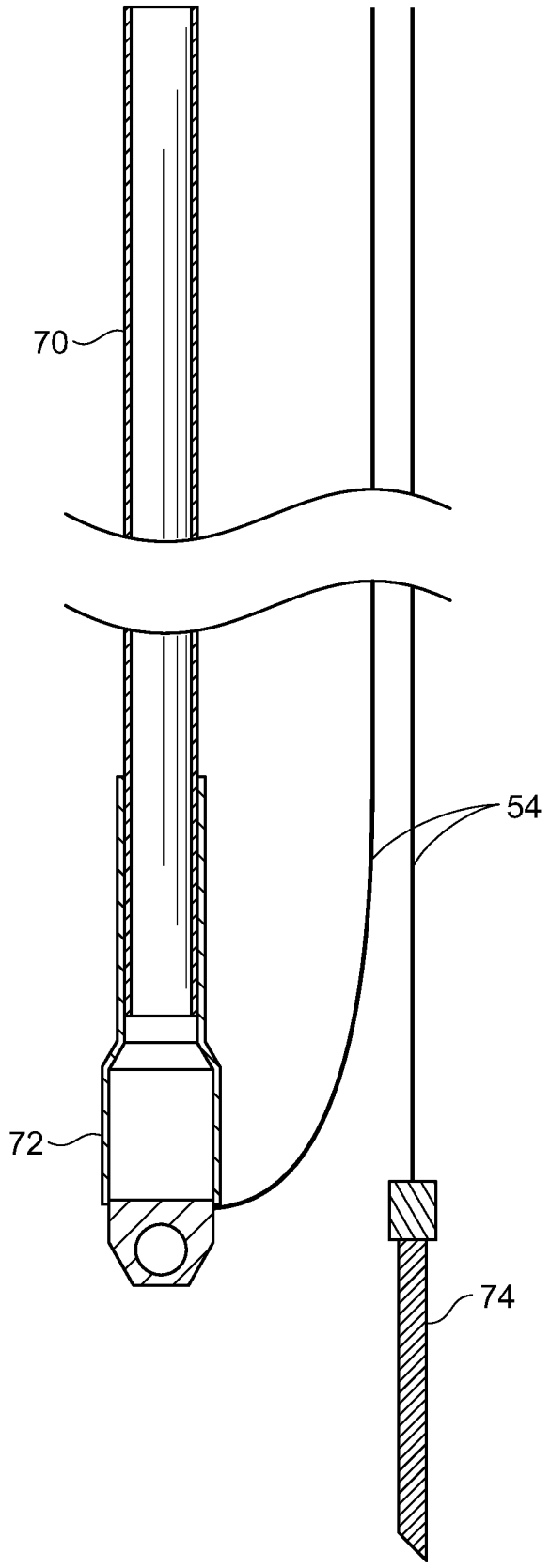
FIG. 4 is another partial sectional view of a portion of a water system where an integrated access box in accordance with an example embodiment may be used.

As mentioned above, the integrated access box 10 can be used to replace and improve such conventional systems, or it can be used for new installations. FIG. 4 illustrates an existing installation with the conventional access lids 46 and 48 removed. Once this is done, a new integrated access box 10 can be slid onto curb box 70, with curb box chamber 20 fitting over the curb box 70. Once the wires 54 are connected to terminals 52, the terminal box 50 can be inserted into the opening 34 in the top 17, and the excavation can be backfilled, with the top 17 of the integrated access box 10 maintained level with the ground surface, as shown in FIGS. 5-7. The stop flange 18, which may be in the form of a ring or surface that extends beyond the cylindrical portion of the body 12, helps to anchor the integrated access box 10 in place, allowing it to move with the ground while the integrated access box 10 slides over curb box 70. The stop flange 18 makes the integrated access box 10 hard to pull out of the ground, and also gives the integrated access box 10 the ability to "float" over the curb box 70 with freeze/thaw movements of the ground. Accordingly, the top of integrated access box 10 stays level with the ground even as the ground level changes relative to the underground curb box.

The integrated access box 10 eliminates the need for separate access boxes. As shown in FIG. 7, the single box 10 allows a tracer signal to be injected by clip 51 onto terminal screws 53, while the curb stop access opening 24 allows conventional equipment (not shown) to be used to access and operate the curb stop valve 72 via curb box 70. For greater ease in working with the wires 54 and terminals 52, the terminal box 50 can be removed from the opening in the top 17 of the body 12, while the wires 54 remain connected, as shown in FIGS. 8 and 10. Thus, with the 2' or more of extra tracer wire within the tracer wire chamber 30, a worker can connect or repair the connections, and apply dielectric grease, etc., to the terminals 52.

Unless otherwise defined, all technical and scientific terms used herein have the same meaning as commonly understood by one of ordinary skill in the art to which this invention belongs. Although methods and materials similar to or equivalent to those described herein can be used in the practice or testing of the integrated access box, suitable methods and materials are described above. All publications, patent applications, patents, and other references mentioned herein are incorporated by reference in their entirety to the extent allowed by applicable law and regulations. The integrated access box may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

What is claimed is:

1. An integrated access box comprising:

a body having a first end and a second end;

a first chamber extending into the first end toward the second end of the body, the first chamber further comprising a first opening proximate the first end of the body;

a first chamber access opening in the first chamber proximate the second end of the body;

a tracer wire chamber extending into the first end toward the second end of the body, the tracer wire chamber further comprising a second opening proximate the first end of the body;

a tracer wire access opening in the tracer wire chamber proximate the second end of the body, wherein the tracer wire access opening provides for electrical access to tracer wires within the tracer wire chamber; and a terminal box sized and shaped to be positioned in the tracer wire access opening, the terminal box comprising a plurality of tracer wire terminals that are electrically connectable to the tracer wires and electrically isolated from the body.

2. The integrated access box of claim 1, wherein the first chamber access opening comprises a threaded opening to accept a threaded lid.

3. The integrated access box of claim 1, wherein the body comprises a substantially cylindrical portion.

4. The integrated access box of claim 3, wherein the first chamber is substantially in the shape of an elongated cylinder extending from the first end toward the second end, and wherein the first chamber is sized to engage a curb box or riser pipe.

5. The integrated access box of claim 3, further comprising a flange that extends beyond the substantially cylindrical portion of the body.

6. The integrated access box of claim 5, wherein the body further comprises a top proximate the second end, and wherein the first chamber access opening in the first chamber comprises an opening in the top; and wherein the tracer wire access opening comprises an opening in the top.

7. The integrated access box of claim 6, wherein the first chamber access opening comprises a threaded opening adapted to accept a threaded lid.

8. The integrated access box of claim 1, wherein the terminal box is removable from the tracer wire access opening.

9. The integrated access box of claim 1, wherein the body further comprises a top proximate the second end, and wherein the first chamber access opening in the first chamber comprises an opening in the top; and wherein the tracer wire access opening comprises an opening in the top.

10. The integrated access box of claim 9, wherein the first chamber access opening comprises a threaded opening adapted to accept a threaded lid.

11. The integrated access box of claim 1, wherein the tracer wire chamber is isolated from the first chamber by the body.

12. An integrated access box comprising:

a body having a first end and a second end;

means for mounting the integrated access box on a curb box;

means for accessing the curb box to adjust a curb stop valve, the means for accessing proximate the second end of the body;

means for containing at least one tracer wire proximate the second end of the body; and means for making an electrical connection to the at least one tracer wire, wherein the means for making the electrical connection is electrically isolated from the body.

13. The integrated access box of claim 12, wherein the means for mounting comprises a threaded opening to accept a threaded lid.

14. The integrated access box of claim 12, wherein the body comprises an elongated cylinder.

15. The integrated access box of claim 12, wherein the body comprises a substantially cylindrical portion.

16. The integrated access box of claim 15, further comprising a flange that extends beyond the substantially cylindrical portion of the body.

17. The integrated access box of claim 12, wherein the means for containing tracer wires is isolated from the means for mounting by the body.

18. The integrated access box of claim 12, wherein the body further comprises a top proximate the second end, and wherein the means for accessing the curb box comprises an opening in the top; and wherein the means for containing the at least one tracer wire comprises an opening in the top.

* * * * *